United States Patent [19]

Graf et al.

[11] Patent Number: 5,042,434

[45] Date of Patent: Aug. 27, 1991

[54] COMBINED CONTROL APPARATUS AND COOLING SYSTEM FOR AN INTERNAL COMBUSTION ENGINE

[75] Inventors: Herbert Graf, Ditzingen; Jürgen Schwenger, Waiblingen; Werner Zimmermann, Gerlingen; Johannes Locher, Stuttgart, all of Fed. Rep. of Germany

[73] Assignee: Robert Bosch GmbH, Stuttgart, Fed. Rep. of Germany

[21] Appl. No.: 519,469

[22] Filed: May 7, 1990

[30] Foreign Application Priority Data

May 13, 1989 [DE] Fed. Rep. of Germany ..... 3915709

[51] Int. Cl.[5] ..... F01P 1/06

[52] U.S. Cl. ..... 123/41.31

[58] Field of Search ..... 123/41.31, 41.12; 165/80.4; 174/15.1

[56] References Cited

U.S. PATENT DOCUMENTS 3,964,444 6/1976 Hemmann et al. ..... 123/41.12
4,168,456 9/1979 Isobe ..... 123/41.12
4,364,355 12/1982 Kariho ..... 123/41.31

FOREIGN PATENT DOCUMENTS 3004822 10/1981 Fed. Rep. of Germany .

OTHER PUBLICATIONS

Article entitled "DDEC II—Advanced Electronic Diesel Control", by R. J. Hames et al., Publication SAE 861049 of the Society of Automotive Engineers.

*Primary Examiner*—Noah P. Kamen
*Attorney, Agent, or Firm*—Walter Ottesen

[57] ABSTRACT

The invention is directed to a control apparatus cooling system which includes a control apparatus arrangement for an internal combustion engine. The control apparatus arrangement is set into operation by an ignition contact signal. The control apparatus arrangement is cooled with the aid of a coolant loop which has a pump motor. A self-holding circuit is provided in the control apparatus arrangement and supplies the pump motor and a voltage stabilization with voltage to drive a microcomputer as soon as the ignition contact signal appears. The cooling of the control apparatus arrangement is not terminated immediately when the ignition contact signal ceases; instead, the pump motor continues to run until it is assured that components having conventional temperature resistance cannot become damaged in the control apparatus arrangement by overheating because of stored heat. The microcomputer determines when the switch-off condition is satisfied. This cooling system affords the advantage that components of conventional temperature resistance can be utilized in the control apparatus arrangement. Furthermore, the advantage is afforded that even after the ignition contact signal ceases, the microcomputer can still conduct self-diagnostic procedures which in conventional systems can only be carried out when the engine is started which then leads to a delay when starting the engine.

8 Claims, 2 Drawing Sheets

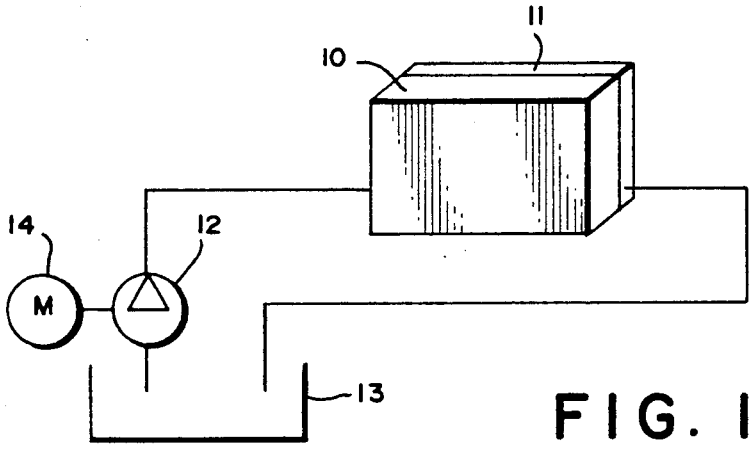
FIG. 1
FIG. 4
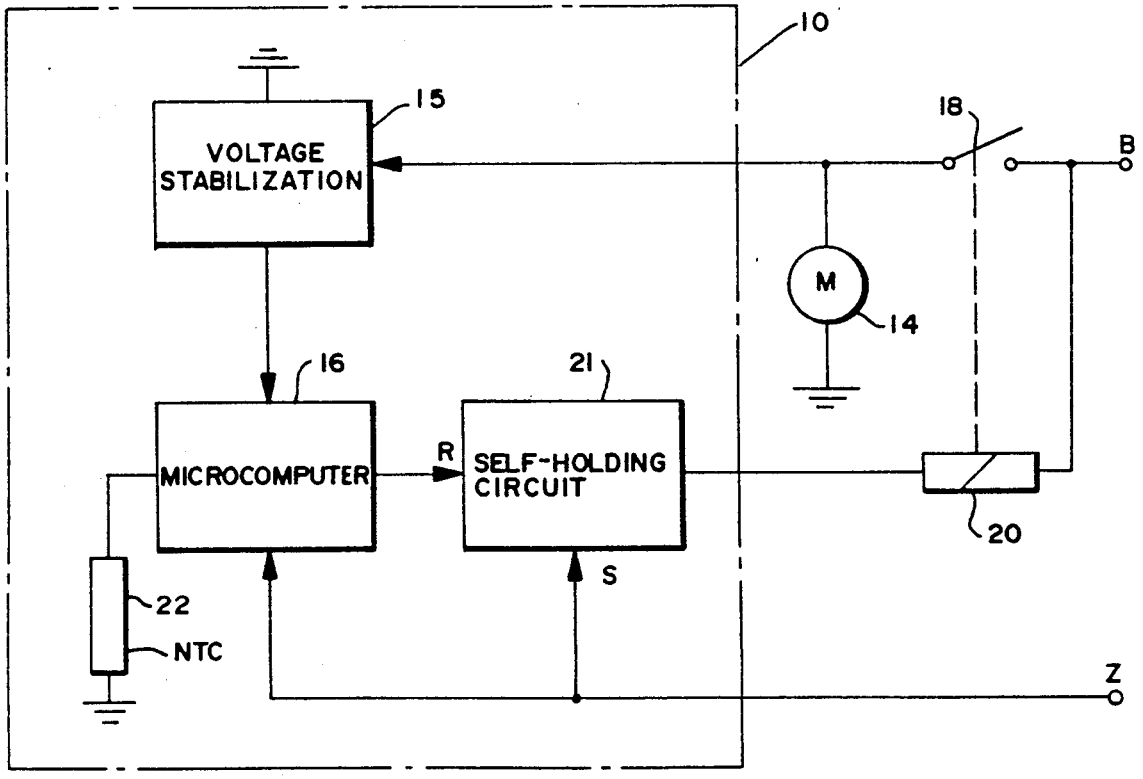

COMBINED CONTROL APPARATUS AND COOLING SYSTEM FOR AN INTERNAL COMBUSTION ENGINE

FIELD OF THE INVENTION

The invention relates to a control apparatus for an internal combustion engine with the control apparatus being provided with cooling. Cooling of this kind is used where a control apparatus is mounted in the engine compartment and must be protected against overheating because of heat radiated from the engine.

BACKGROUND OF THE INVENTION

A cooling system for a control apparatus is disclosed in an article by R. J. Hames et al entitled "DDEC II—Advanced Electronic Diesel Control" appearing in the publication SAE 861049 of the Society of Automotive Engineers. This control apparatus cooling system includes a control apparatus arrangement for controlling a diesel engine and this arrangement is placed in operation by an ignition contact signal. A cooling arrangement is cooled by a coolant loop having a coolant pump and the control apparatus arrangement is connected with the cooling arrangement so as to provide good conductivity. The control apparatus is equipped with components which suffer no damage up to a temperature of 125° C. In this way, it is assured that even when stored heat is radiated after switching off the diesel engine, the control apparatus arrangement will not be destroyed.

The requirement that high-temperature stable components for control apparatus be used when the apparatus is mounted in the engine compartment has long been viewed as a disadvantage. This is the case since such components are considerably more expensive than components with conventional temperature resistance.

SUMMARY OF THE INVENTION

The control apparatus cooling system according to the invention includes means for periodically applying a supply voltage to a coolant pump device even after the ignition contact signal is discontinued. The supply voltage is applied until a pregiven condition is fulfilled. This condition can, for example, be the elapse of a pregiven time duration or after a pregiven sufficiently low temperature is reached or both.

The coolant loop continues to be operated even after the ignition contact signal is discontinued. This assures that the stored heat acting on the control apparatus is conducted away from this apparatus. This makes it possible to use components of conventional temperature resistance.

The control apparatus is usually cooled with the aid of fuel. German Patent 30 04 822 discloses that a fuel pump can still be operated after discontinuing the ignition contact signal. However, this does not relate to a fuel coolant pump and instead relates to a fuel pump for pumping fuel to injection valves. The pump is then set in operation when the fuel pressure falls because of the formation of gas bubbles. The fuel pressure is then again increased so that an adequately high pressure is immediately available for a starting operation which takes place some time later. In the present case, it is not the fuel pressure which is increased but the fuel is pumped so as to be recirculated in order to cool a control apparatus arrangement.

It is also known to recirculate the coolant for an engine even after the ignition contact signal is discontinued for a specific time duration or until a pregiven relatively low temperature is reached in order to prevent the engine from becoming damaged by stored heat. However, this measure up to now has not provided persons working in this area with any suggestion that a similar measure could also be used in the fuel loop for cooling a control apparatus arrangement. The signal which acts to switch off the coolant pump for the motor cooling loop in conventional arrangements can simultaneously operate on the coolant pump device in a control apparatus cooling system. In this way, a control apparatus cooling system according to the invention is realized in a most simple manner wherein the supply voltage of the coolant pump arrangement is supplied even after discontinuing the ignition contact signal until a pregiven condition is fulfilled.

It is a special advantage to equip the control apparatus cooling system with a self-holding circuit which is set by the ignition contact signal which drives a relay in the set condition which, in the driven condition, applies the supply voltage to the control apparatus arrangement and the coolant pump device. The self-holding circuit is reset by a pulse which is supplied by a microcomputer in the control apparatus arrangement as soon as a pregiven condition is satisfied after the ignition contact signal is discontinued.

A control apparatus cooling system having such a self-holding circuit affords several advantages. One advantage is the general advantage already described, namely, that an after-cooling can take place after the engine is switched off. A further advantage is that a microcomputer which is anyway present can be utilized to evaluate if the pregiven condition is satisfied which, when reached, disconnects the coolant pump arrangement from the supply voltage. A third advantage is that when the microcomputer is still driven with the aid of the self-holding circuit, self diagnostic operations can already be conducted in the manner in which they are otherwise performed when starting the engine. Accordingly, time is saved during the starting operation.

BRIEF DESCRIPTION OF THE DRAWINGS

The invention will now be described with reference to the drawings wherein:

FIG. 1 is a schematic of a control apparatus cooling system having a control apparatus and a coolant loop;

DESCRIPTION OF THE PREFERRED EMBODIMENTS OF THE INVENTION

Figure 2:
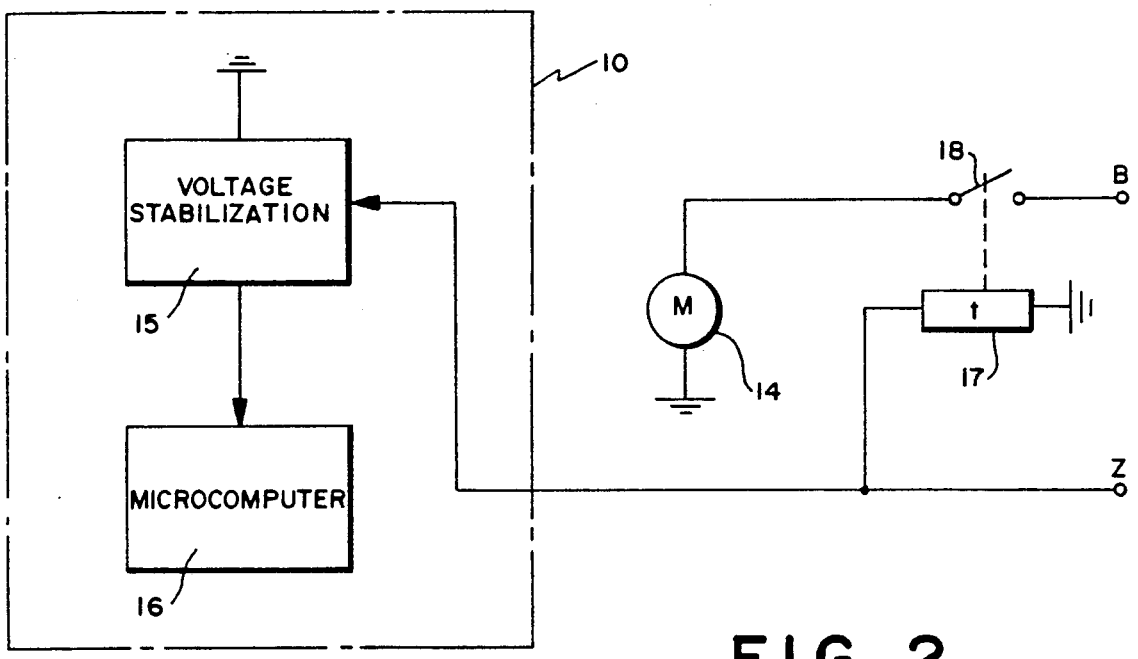
FIG. 2 is a block diagram of a control apparatus cooling system having a time-delay relay for after-cooling a control apparatus when the engine is switched off.

The arrangement shown in FIG. 1 cools a control apparatus 10. A control apparatus arrangement can include several control apparatus in lieu of a single control apparatus 10. The control apparatus 10 is connected to a cooling plate 11 in a good heat conductive manner. The cooling plate 11 can also be integrated into the control apparatus. Fuel flows through the cooling plate 11 and this fuel is drawn by suction from the fuel tank 13 by a coolant pump 12 and this fuel again returns to the tank with the aid of lines through the cooling plate 11. The coolant pump 12 is driven by a pump motor 14. It is noted that in lieu of fuel from the fuel tank 13, fuel can also be pumped from another supply tank. In lieu of fuel, another coolant can be utilized.

FIG. 2 shows that the control apparatus 10 can include a voltage stabilization 15 and a microcomputer 16. As soon as a voltage is applied to a contact Z as an ignition contact signal by actuating the ignition key, this voltage is supplied to the voltage stabilization 15 which then supplies the microcomputer 16 with a stabilized voltage. Furthermore, a time-delay relay 17 receives the ignition contact signal whereby it becomes energized and closes a motor switch 18. When closed, the motor switch 18 connects the pump motor 14 to a battery contact B on which the voltage from the battery is present.

The microcomputer 16 and the pump motor 14 operate when the ignition contact signal appears on the contact Z. If the ignition contact signal is discontinued, the control apparatus 10 directly terminates its operation but the pump motor 14 continues to run for a time duration (t) and this time duration is determined by the time function of the time-delay relay 17. This time duration is selected to be so long that even under very unfavorable conditions, cooling takes place sufficiently long to ensure that components having conventional temperature resistance do not become damaged in the control apparatus 10 because of stored heat. The time duration (t) typically amounts to 10, 20, 30, 40 or 50 seconds and can be up to a few minutes.

Figure 3:
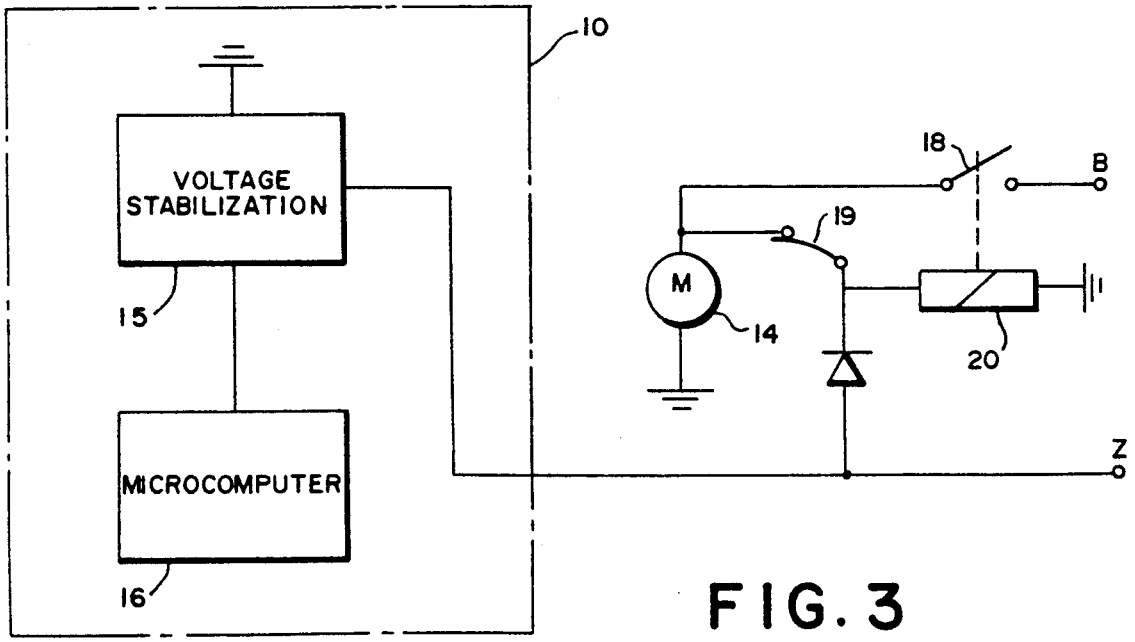
FIG. 3 is a block diagram corresponding to the diagram of FIG. 2 but with a bimetal switch in lieu of a time-delay relay for carrying out the after-cooling operation; and, FIG. 4 is a block diagram corresponding to the diagram of FIG. 2 but with a self-holding circuit provided in the control apparatus for controlling the after-cooling operation.

The embodiment of FIG. 3 is different from the embodiment shown in FIG. 2 in that a bimetal switch 19 is used to trigger an after-cooling operation instead of a time-delay relay 17.

The bimetal switch 19 lies in a self-holding path for a relay 20 which actuates the motor switch 18. This relay 20 is immediately energized in the same manner as time-delay relay 17 as soon as voltage appears at contact Z. The relay 20 then closes the motor switch 18 whereby the pump motor 14 is supplied with voltage from contact B. When the coolant heats during operation of the engine, the bimetal switch 19 also heats. The bimetal switch 19 finally reaches a temperature at which it closes and this position is shown in FIG. 3. In the closed position, the bimetal switch 19 makes the relay 20 self-holding. If the ignition contact signal is now discontinued, the relay 20 remains closed until the bimetal switch 19 has cooled down so far that it opens the self-holding path.

The circuit according to FIG. 3 affords the advantage that an after-cooling only then takes place if it is actually required. If the engine was operated only so long that the coolant and therefore the bimetal switch 19 only reached a temperature at which no after-cooling is required, then the bimetal switch is still open when the ignition contact signal is discontinued and for this reason, the relay 20 is not yet self-holding so that the relay 20 immediately separates the pump motor 14 from the voltage at the battery contact B when the ignition contact signal is discontinued.

Embodiments having self-holding circuits are preferred. An example of such an embodiment will now be explained with reference to FIG. 4.

In the embodiment according to FIG. 4, a self-holding circuit 21 is present in the control apparatus 10 in addition to the voltage stabilization 15 and the microcomputer 16. At this point, it is noted that a control apparatus can contain still further function groups and that, on the other hand, the self-holding circuit 21 and/or the voltage stabilization 15 can be mounted outside of the control apparatus. What is important in the embodiment of FIG. 4 is that the voltage stabilization 15 is no longer supplied with voltage from contact Z; instead, the voltage stabilization 15 is supplied with voltage from battery contact B. This condition is however only then present if a relay 20 closes the motor switch 18 referred to above. The one terminal of the relay 20 is connected to the battery contact B and is therefore supplied with voltage. The other terminal is connected to the self-holding circuit 21. This other terminal is grounded as soon as the self-holding circuit 21 receives the ignition contact signal from contact Z at its set input S. It is noted that the self-holding circuit can also conduct the voltage of the ignition contact signal further and then the other terminal of relay 20 must be grounded.

As soon as the ignition contact signal is supplied, the self-holding circuit 21 is set and the relay 20 is energized and closes the motor switch 28 whereupon the pump motor 14 runs and the voltage stabilization 15 in the control apparatus is supplied with voltage. The voltage stabilization 15 applies a stabilizing voltage to the microcomputer 16. The contact ignition signal from contact Z is also supplied to the microcomputer 16; however, not to supply the microcomputer 16 with voltage but instead to indicate to the microcomputer when the ignition contact signal is present and when it is discontinued. As soon as the microcomputer 16 determines that the ignition contact signal is no longer present, it permits a procedure to run through which determines how long the pump motor 14 should still continue to run. For example, a time duration is measured by counting clock signals and when this time duration has elapsed, the microcomputer 16 emits a signal to the reset input R of the self-holding circuit 21. This then switches the relay 20 off so that the motor switch 18 opens and separates the pump motor 14 as well as the voltage stabilization 15 from the battery voltage. The microcomputer can determine the time duration as a function of the coolant temperature of the engine. This temperature is supplied to a microcomputer in a control apparatus in a routine manner. The control apparatus 10 can, however, be provided with its own temperature measuring element such as an NTC-resistor 22. The signal of this temperature measuring element is fed to the microcomputer 16 which compares this signal to a desired value. As soon as a determination is made that the actual temperature has reached the desired temperature from values above the desired temperature or has dropped below the desired temperature, a reset signal is emitted.

The embodiment described above makes clear that it is advantageous if the microcomputer 16 can be utilized in order to determine whether a predetermined condition for ending the after-cooling has been reached. This advantage is realizable with the aid of the self-holding circuit 21 which, in contrast to the function of known arrangements, assures that the microcomputer can continue to operate even after the ignition contact signal is discontinued. With this continued operation, it is also possible to conduct, for example, self-diagnostic functions after the engine has been switched off so that these operations must not be then carried out when the engine is again started. If such self-diagnostic functions are carried out, it is advantageous if the microcomputer 16 emits the reset signal in a time-delayed manner in each case and even if the main condition for ending the after-cooling phase is not the elapse of a predetermined time duration but is instead that the desired temperature has been reached. Even if the actual temperature is below the desired temperature, the reset signal is not emitted immediately but only after the self-diagnostic process has been completed.

The self-holding circuit 21 is advantageously so configured that it cannot be reset by a reset signal at its reset input R as long as the ignition contact signal is present at its set input S. Unwanted reset signals can, for example, occur when the microcomputer 16 operates defectively. The measure just described assures that the voltage stabilization 15 continues to operate even with such a defect and can drive an auxiliary computer which is provided in many systems. The switch-off of the self-holding circuit 21 can either take place by means of a signal from the auxiliary computer or in that the self-holding circuit 21 has its own time element which assures that the relay 20 will no longer be supplied with voltage after a predetermined time duration after the ignition contact signal is discontinued.

The signal of a temperature control arrangement can additionally operate on the pump motor 14 to drive the pump motor in that time during which the ignition contact signal is present only when a cooling of the control apparatus arrangement 10 is actually required. For this purpose, a switch is connected in series with the pump motor 14 and this switch is driven by the temperature control arrangement, preferably, the microcomputer. The microcomputer 16 then evaluates the signal from the temperature element 22 not only when the ignition contact signal no longer is present but it evaluates this signal continuously and compares it continuously with a desired value. The switch just mentioned above is so driven that it separates the pump motor 14 from the supply voltage always when the actual value lies below the desired value.

It is understood that the foregoing description is that of the preferred embodiments of the invention and that various changes and modifications may be made thereto without departing from the spirit and scope of the invention as defined in the appended claims.

What is claimed is:

1. A combined control apparatus and cooling system for an internal combustion engine, the system comprising:

a control apparatus arrangement adapted to become operational upon receiving an ignition contact signal;

a cooling unit connected to said control apparatus arrangement for cooling said arrangement;

a coolant loop for conducting a coolant to and from said cooling unit;

pump means for pumping the coolant through said coolant loop;

voltage supply means for providing a supply voltage;

time-delay switching means for applying said supply voltage to said pump means after said ignition contact signal is discontinued and until a pregiven condition is satisfied; and, said time-delay switching means including: responsive switch means responsive to a drive signal for connecting said supply voltage to said control apparatus arrangement and said pump means; and, a self-holding circuit having a set input for receiving said ignition contact signal and being adapted to emit said drive signal in response to said ignition contact signal; said control apparatus arrangement including a microcomputer for emitting a reset pulse immediately in response to the satisfaction of said condition after said ignition contact signal has been discontinued; and, said self-holding circuit having a reset input for receiving said reset pulse and being adapted to end said drive signal to said responsive switch means upon receiving said reset pulse thereby disconnecting said supply voltage from said control apparatus arrangement and said pump means.

2. The system of claim 1, said control apparatus arrangement including temperature measuring means for supplying a temperature actual value to said microcomputer; said microcomputer being adapted to compare said actual value with a desired value of temperature and to emit said reset pulse as soon as said actual value drops below said desired value after said contact ignition signal has been discontinued.

3. The system of claim 1, said control apparatus arrangement being adapted to have a time measurement function for emitting said reset pulse as soon as a pregiven time duration has elapsed after said contact ignition signal has been discontinued.

4. The system of claim 1, said control apparatus arrangement including temperature measuring means for supplying a temperature actual value to said microcomputer; said microcomputer being adapted to compare said actual value with a desired value of temperature and to emit said reset pulse as long as said actual value is less than said desired value thereby always causing said drive signal and said supply voltage to said pump means to be interrupted as long as said actual value remains below said desired value.

5. The system of claim 1, said coolant having a temperature which varies in the course of the operation of the engine and after the engine is switched off; and, said pregiven condition being when a predetermined value of said temperature is reached.

6. The system of claim 1, said coolant having a temperature which varies in the course of the operation of the engine and after the engine is switched off; and, said pregiven condition being the elapse of a predetermined time duration after said ignition contact signal has been discontinued and when a predetermined value of said temperature is reached.

7. The system of claim 1, said condition being the elapse of a pregiven time duration.

8. The system of claim 1, said responsive switch means including relay means responsive to a drive signal for connecting said supply voltage to said control apparatus and said pump means.

* * * * *